US010662762B2

(12) United States Patent
Alnughaimish et al.

(10) Patent No.: US 10,662,762 B2
(45) Date of Patent: May 26, 2020

(54) CASING SYSTEM HAVING SENSORS

(71) Applicant: Saudi Arabian Oil Company, Dhahran (SA)

(72) Inventors: Faisal N. Alnughaimish, Dhahran (SA); Jonathan Mosquera Jimenez, Al Khobar (SA); Ossama R. Sehsah, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 77 days.

(21) Appl. No.: 15/801,428

(22) Filed: Nov. 2, 2017

(65) Prior Publication Data

US 2019/0128115 A1 May 2, 2019

(51) Int. Cl.

| | |
|---|---|
| ***E21B 47/10*** | (2012.01) |
| ***E21B 47/06*** | (2012.01) |
| ***E21B 43/10*** | (2006.01) |
| ***E21B 47/01*** | (2012.01) |

(52) U.S. Cl.

CPC ..... *E21B 47/1025* (2013.01); *E21B 43/10* (2013.01); *E21B 47/01* (2013.01); *E21B 47/065* (2013.01)

(58) Field of Classification Search

None

See application file for complete search history.

(56) References Cited

U.S. PATENT DOCUMENTS

| | | | |
|---|---|---|---|
| 4,553,428 | A | 11/1985 | Upchurch |
| 4,601,343 | A | 7/1986 | Lindsey, Jr. et al. |
| 4,688,642 | A | 8/1987 | Baker |
| 5,020,597 | A | 6/1991 | Braddick et al. |
| 5,181,570 | A | 1/1993 | Allwin et al. |
| 5,279,369 | A | 1/1994 | Brammer |
| 5,435,392 | A | 7/1995 | Kennedy |
| 5,743,333 | A | 4/1998 | Willauer et al. |
| 5,975,204 | A | 11/1999 | Tubel et al. |
| 6,425,444 | B1 | 7/2002 | Metcalfe et al. |
| 6,499,537 | B1 | 12/2002 | Dewey et al. |
| 6,513,596 | B2 | 2/2003 | Wester |
| 6,540,024 | B2 | 4/2003 | Pallini et al. |
| 6,633,236 | B2 | 10/2003 | Vinegar et al. |
| 6,679,332 | B2 | 1/2004 | Vinegar et al. |
| 6,766,854 | B2 | 7/2004 | Ciglenec et al. |
| 6,789,621 | B2 | 9/2004 | Wetzel et al. |
| 6,817,410 | B2 | 11/2004 | Wetzel et al. |
| 6,834,725 | B2 | 12/2004 | Whanger et al. |
| 6,899,178 | B2 | 5/2005 | Tubel |

(Continued)

OTHER PUBLICATIONS

International Search Report for PCT/IB2018/056510, 4 pages (dated Dec. 21, 2018).

(Continued)

*Primary Examiner* — Shane Bomar

(74) *Attorney, Agent, or Firm* — Choate, Hall & Stewart LLP; Charles E. Lyon; Alexander D. Augst

(57) ABSTRACT

An example method includes connecting a casing liner device to a polished bore receptacle (PBR) of a liner hanger outside of a wellbore. The PBR includes a first connection mechanism. The casing liner device includes second connection mechanism that connects to the first connection mechanism. The casing liner device connected to the PBR is run into the wellbore in tandem.

15 Claims, 5 Drawing Sheets

(56) References Cited

U.S. PATENT DOCUMENTS

| | | | | |
|---|---|---|---|---|
| 6,913,079 | B2 | 7/2005 | Tubel | |
| 6,957,576 | B2 | 10/2005 | Skinner et al. | |
| 7,104,324 | B2 | 9/2006 | Wetzel et al. | |
| 7,114,561 | B2 | 10/2006 | Vinegar et al. | |
| 7,121,351 | B2 | 10/2006 | Luke et al. | |
| 7,182,134 | B2 | 2/2007 | Wetzel et al. | |
| 7,234,528 | B2 | 6/2007 | Pallini, Jr. et al. | |
| 7,316,274 | B2 | 1/2008 | Xu et al. | |
| 7,389,685 | B2 | 6/2008 | Kosht et al. | |
| 7,554,458 | B2 | 6/2009 | Hudson et al. | |
| 7,784,552 | B2 | 8/2010 | Brouse | |
| 7,836,973 | B2 | 11/2010 | Belcher et al. | |
| 7,845,404 | B2 | 12/2010 | McStay et al. | |
| 7,861,789 | B2 | 1/2011 | Nelson | |
| 7,870,898 | B2 | 1/2011 | Yeh et al. | |
| 8,066,059 | B2 | 11/2011 | Ferguson et al. | |
| 8,091,631 | B2 | 1/2012 | Wetzel et al. | |
| 8,230,913 | B2 | 7/2012 | Hart et al. | |
| 8,302,697 | B2 | 11/2012 | Kuo | |
| 8,312,923 | B2 | 11/2012 | Patel et al. | |
| 8,400,326 | B2 | 3/2013 | Codazzi | |
| 8,476,583 | B2 | 7/2013 | Legrand et al. | |
| 8,522,867 | B2 | 9/2013 | Yeh et al. | |
| 8,550,175 | B2 | 10/2013 | Shafiq et al. | |
| RE45,011 | E | 7/2014 | Schetky et al. | |
| 8,789,612 | B2 | 7/2014 | Haeberle et al. | |
| 8,881,843 | B2 | 11/2014 | Todd et al. | |
| 9,022,113 | B2 | 5/2015 | Rex et al. | |
| 9,274,243 | B2 | 3/2016 | Chau et al. | |
| 9,322,248 | B2 | 4/2016 | Yeh et al. | |
| 9,422,786 | B2 | 8/2016 | Yokley et al. | |
| 2002/0074119 | A1* | 6/2002 | Bixenman | E21B 43/08 166/278 |
| 2004/0177967 | A1* | 9/2004 | Hirth | E21B 33/12 166/311 |
| 2005/0006106 | A1* | 1/2005 | Hirth | E21B 23/04 166/382 |
| 2005/0168349 | A1* | 8/2005 | Huang | E21B 47/182 340/854.3 |
| 2006/0017287 | A1 | 1/2006 | Milberger | |
| 2006/0060352 | A1* | 3/2006 | Vidrine | E21B 43/045 166/276 |
| 2007/0267221 | A1* | 11/2007 | Giroux | E21B 7/20 175/57 |
| 2008/0308274 | A1 | 12/2008 | MacDougall | |
| 2009/0090499 | A1 | 4/2009 | Lewis et al. | |
| 2009/0200041 | A1 | 8/2009 | Watson | |
| 2015/0136393 | A1* | 5/2015 | Turley | E21B 43/10 166/285 |
| 2015/0330200 | A1 | 11/2015 | Richard et al. | |
| 2016/0010415 | A1* | 1/2016 | Myhre | E21B 33/13 166/290 |
| 2016/0102523 | A1* | 4/2016 | Sponchia | E21B 33/14 166/250.14 |
| 2018/0135378 | A1* | 5/2018 | Budde | E21B 23/04 |
| 2018/0223615 | A1* | 8/2018 | Luke | E21B 33/04 |
| 2018/0252053 | A1* | 9/2018 | Rico | E21B 17/06 |
| 2018/0313179 | A1* | 11/2018 | Kandaswami | E21B 23/01 |
| 2018/0320487 | A1* | 11/2018 | Themig | E21B 43/08 |
| 2019/0128098 | A1* | 5/2019 | Ross | E21B 34/066 |

OTHER PUBLICATIONS

Written Opinion for PCT/IB2018/056510, 8 pages (dated Dec. 21, 2018).

* cited by examiner

CASING SYSTEM HAVING SENSORS

TECHNICAL FIELD

This specification relates generally to a casing system that has sensors for detecting environmental conditions in a wellbore.

BACKGROUND

Some wellbores, such as high-pressure, high-temperature (HPHT) wellbores, may benefit from isolation of secondary reservoirs. For example, isolation of secondary reservoirs may mitigate potential problems with casing-to-casing annular (CCA) integrity and tubing-to-casing (TCA) annular integrity. To implement isolation, it is known to run a production cemented liner into the wellbore. Running the production cemented liner includes installing a polished bore receptacle (PBR) in the wellbore. Next steps may include connecting a casing string to the pre-installed PBR, and, in some cases, cementing the casing string from the PBR to the wellhead. These steps, which together are part of a tie-back operation, require several trips into the wellbore. Because tie-back operations, such as these, require several trips into the wellbore, they can add time and cost to drilling operations.

Standard casing strings having an external casing packer (ECP), mid-string packers, or differential valve (DV) tools are also known, and can be used to isolate secondary reservoirs. However, in standard casings strings, these components may require tools, for example, to perform cementing operations, that may result in weak points on the casing string. Weak points, such as these, may become a leak path and increase the risk of TCA/CCA issues that affect well integrity.

SUMMARY

An example method includes connecting a casing liner device to a polished bore receptacle (PBR) of a liner hanger outside of a wellbore. The PBR includes a first connection mechanism. The casing liner device includes second connection mechanism that connects to the first connection mechanism. The casing liner device connected to the PBR is run into the wellbore in tandem. The example method may include one or more of the following features, either alone or in combination.

The example method may include connecting a packer to the PBR outside the wellbore. Running the casing liner device and the PBR into the wellbore may include running the packer into the wellbore along with the casing liner device and the PBR. The liner hanger may include a liner hanger slip connected to the PBR. Running the casing liner device and the PBR into the wellbore also may include running the liner hanger slip into the wellbore along with the casing liner device and the PBR.

The casing liner device, the PBR, and the packer may constitute a connected structure. The connected structure may include environmental sensors for sensing one or more environmental conditions within the wellbore. The environmental sensors may include a temperature sensor for sensing a temperature within the wellbore. The environmental sensors may include a pressure sensor for sensing a pressure within the wellbore. The environmental sensors may include a first sensor up-hole from the packer and a second sensor down-hole from the packer. Readings from the first sensor and the second sensor may be usable to detect a leak within the wellbore.

The example method may include, following running the casing liner device connected to the PBR into the wellbore, performing a cementing operation within the wellbore; disconnecting the casing liner device from the PBR to cause the casing liner device to move up-hole relative to the PBR and, as a result of movement up-hole, to expose circulation ports on the casing liner device to the wellbore; and pumping excess cement from the wellbore via the circulation ports.

The wellbore may have at least one of a temperature in excess of 250° Fahrenheit or a pressure in excess of 7500 pounds-per-square-inch (PSI).

An example system includes: a polished bore receptacle (PBR) that is part of a liner hanger for use in a wellbore, where the PBR includes first threading; a casing liner device for performing tie-back in the wellbore, where the casing liner device includes second threading that is connectable to the first threading; and environmental sensors for detecting one or more environmental conditions in the wellbore when the casing liner device and the PBR are inside the wellbore. The example system may include one or more of the following features, either alone or in combination.

The example system may include a packer connected to the PBR. The packer is for sealing the wellbore when the casing liner device and the PBR are inside the wellbore. The environmental sensors may include at least one sensor up-hole of the packer and at least one sensor down-hole of the packer. The example system may include a liner hanger slip connected to the PBR for supporting a casing liner. The environmental sensors may include a temperature sensor for sensing a temperature within the wellbore. The environmental sensors may include a pressure sensor for sensing a pressure within the wellbore. The environmental sensors may include a first sensor up-hole from the packer and a second sensor down-hole from the packer. The example system may include a computing system to receive readings from the first sensor and the second sensor and to detect a leak within the wellbore based on the readings.

The example system may be usable within the wellbore at a temperature in excess of 250° Fahrenheit, at a pressure in excess of 7500 pounds-per-square-inch (PSI), or at a temperature in excess of 250° Fahrenheit and a pressure in excess of 7500 pounds-per-square-inch (PSI).

The casing liner device may include circulation ports that are within the PBR when the casing liner and the PBR are connected, and that are exposable to the wellbore when the casing liner device and the PBR are disconnected and the casing liner device is moved up-hole form the PBR. The PBR may overlap the casing liner device, at least partly, such that the casing liner device is disconnectable from the PBR and movable within the PBR inside the wellbore.

Any two or more of the features described in this specification, including in this summary section, may be combined to form implementations not specifically described in this specification.

All or part of the methods, systems, and techniques described in this specification may be controlled by executing, on one or more processing devices, instructions that are stored on one or more non-transitory machine-readable storage media. Examples of non-transitory machine-readable storage media include read-only memory, an optical disk drive, memory disk drive, random access memory, and the like. All or part of the methods, systems, and techniques described in this specification may be controlled using a computing system comprised of one or more processing devices and memory storing instructions that are executable by the one or more processing devices to perform various control operations.

The details of one or more implementations are set forth in the accompanying drawings and the description subsequently. Other features and advantages will be apparent from the description and drawings, and from the claims.

DESCRIPTION OF THE DRAWINGS

Like reference numerals in different figures indicate like elements.

DETAILED DESCRIPTION

Described in this specification are example techniques for installing a casing liner system into a wellbore. An example casing liner system includes, among other components, a polished bore receptacle (PBR) that is connected to a casing liner hanger supporting a casing liner; a casing liner device that is connectable to the PBR, and environmental sensors for detecting one or more environmental conditions in the wellbore. The casing liner device may be a mechanical device that ties the casing liner back to the wellhead, and that supports delivery of material and fluids into, and out of, the well. In some implementations, the casing liner device is connected to the PBR outside of the wellbore, and the resulting connected structure is then run in tandem into the wellbore in a single running operation. A packer may also be part of the casing system, and may be physically connected to the PBR.

The environmental sensors are connected at positions up-hole from, and down-hole from, the packer to sense environmental conditions, such as temperature and pressure. Connection between the packer and the PBR, and connection of the environmental sensors relative to the packer, also occurs outside of the wellbore.

Thus, a connected structure that constitutes at least part of an overall casing liner system is formed outside of the wellbore. As noted, the connected structure that forms at least part of the casing liner system may be run into the wellbore in a single operation. As part of that operation, the casing liner device, the PBR, the packer, and the casing liner are run in tandem into the wellbore, reducing the need for multiple trips into, and out of, the wellbore. As a result, the casing liner system may save cost and time relative to systems, including those that implement tie-backs, that require multiple trips into, and out of, the wellbore. In addition, incorporating the environmental sensors into the casing liner system enables measurement of environmental conditions both during formation of the well and following formation of the well. For example, one or more sensors may be used to detect pressure and temperature up-hole and down-hole from the packer, which may enable, or at least facilitate, detection of leaks or other problems with the well.

Figure 1:
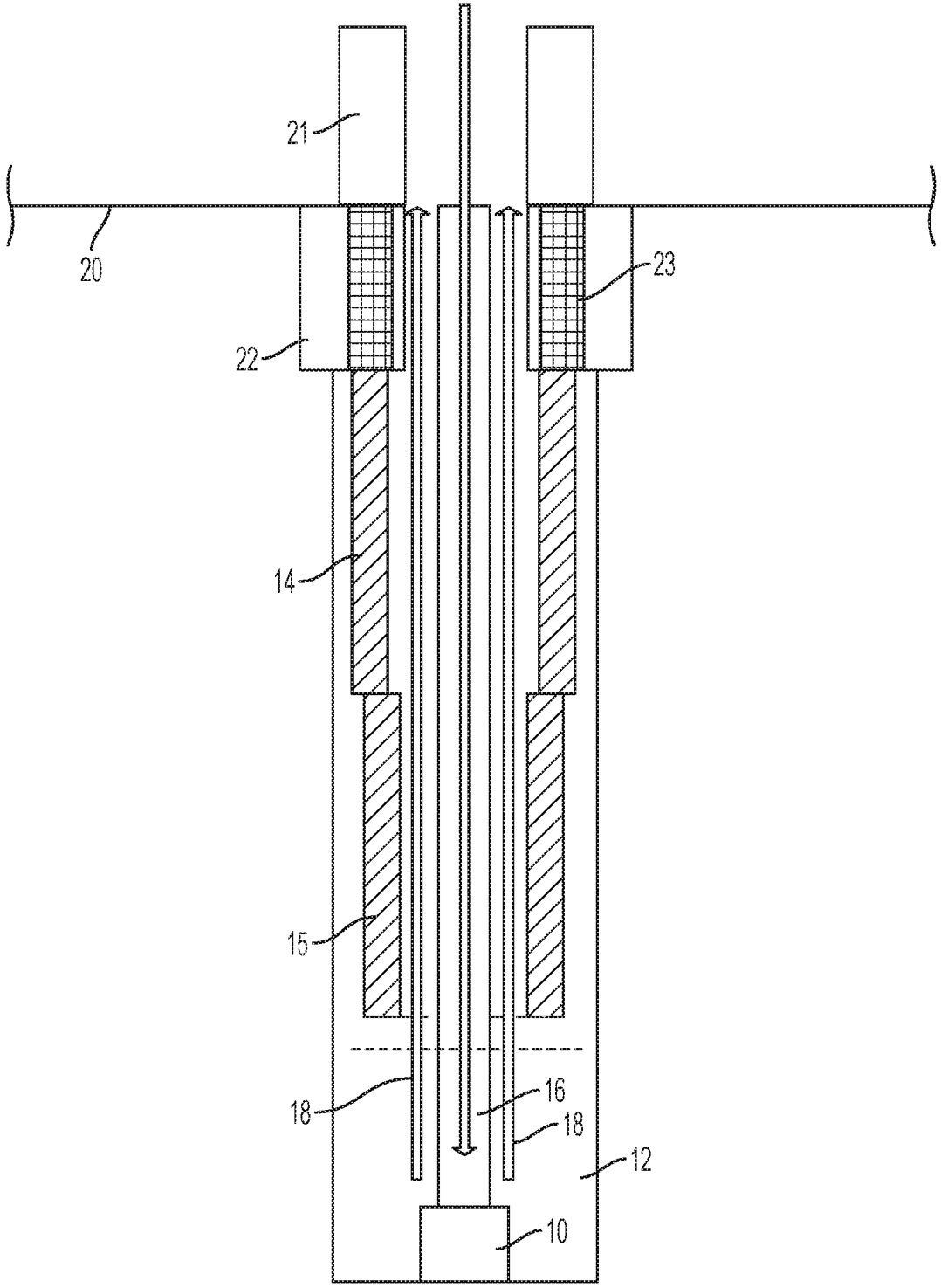
FIG. 1 is a cross-section of an example wellbore.

Referring to FIG. 1, to produce a well, a drill 10 bores through earth, rock, and other materials to form a wellbore 12. The drilling process includes, among other things, pumping drilling fluid 16 down into the wellbore, and receiving return fluid 18 containing materials from the wellbore at surface 20. In some implementations, the drilling fluid includes water- or oil-based mud and, in some implementations, the return fluid contains mud, rock, and other materials to be evacuated from the wellbore. In order for the well to become a production well, the well must be completed. Part of the completion process includes incorporating a casing into the wellbore. A casing, such as casing 14, supports the sides of the wellbore, and protects components of the well from outside contaminants. In some cases, additional casing, such as casing 15, may be suspended from casing that is up-hole of the additional casing. Although only two casings are shown, any appropriate number of casings may be incorporated into the well. The casings may be cemented in place. Cementing operations include introducing cement slurry into the space between the casing and the wellbore, and allowing the cement slurry to set. Allowing the cement slurry to set may include allowing the cement slurry to reach a predefined hardness. Cementing operations may be performed in one stage, two stages, or more than two stages in some implementations.

The casing may include a casing liner. A casing liner may be similar to a casing string since both may be made of joints and tubing. However, in some cases, the casing liner may be hung in the wellbore from a liner hanger 22, and tied-back to the surface 20 using a tie-back device, referred to as a casing liner device 23, that may act as a tie-back to wellhead 21. In this regard, the elements of FIG. 1, including the liner hanger, are not shown to scale. The casing liner may then be cemented in place inside the wellbore. In some cases, the wellbore is sealed using a packer. In an example, a packer includes a device that has a smaller diameter than the wellbore, that is run into the wellbore, and that expands outwardly within the wellbore to seal the wellbore at the point of the packer. The sealing may isolate down-hole formations and fluids within the wellbore from components of the well that are up-hole from the packer and from up-hole formations and fluids. A packer may also be used to implement a positive seal between tandem casing strings or other components.

In some implementations, the packer may be, or include, a mid-string packer, an external casing packer (ECP), a high-pressure, high-temperature (HPHT) differential valve (DV), or any other appropriate isolating device or devices.

During completion of the well, a casing liner is run and cemented in the wellbore. At the top of a liner hanger supporting the casing liner is a polished bore receptacle (PBR) that is configured to accept a seal assembly. The PBR includes a connection mechanism, such as an internal right-hand thread, that enables other devices to connect to the PBR. In prior systems, a tie-back casing liner was introduced into the well after the PBR, liner hanger, and casing liner were already run into the well. In the example techniques described in this specification, connections between a casing liner device for implemented tie-back, the PBR on the liner hanger, the packer, and the casing liner are made outside of the wellbore to produce a connected structure. The connected structure is then run into the wellbore in tandem—in some examples, in a single operation, which reduces the number of trips required into the wellbore and, thus, the time and expense associated with forming the well.

In some implementations, additional components are connected to the connected structure either outside, or inside, the wellbore.

Figure 2:
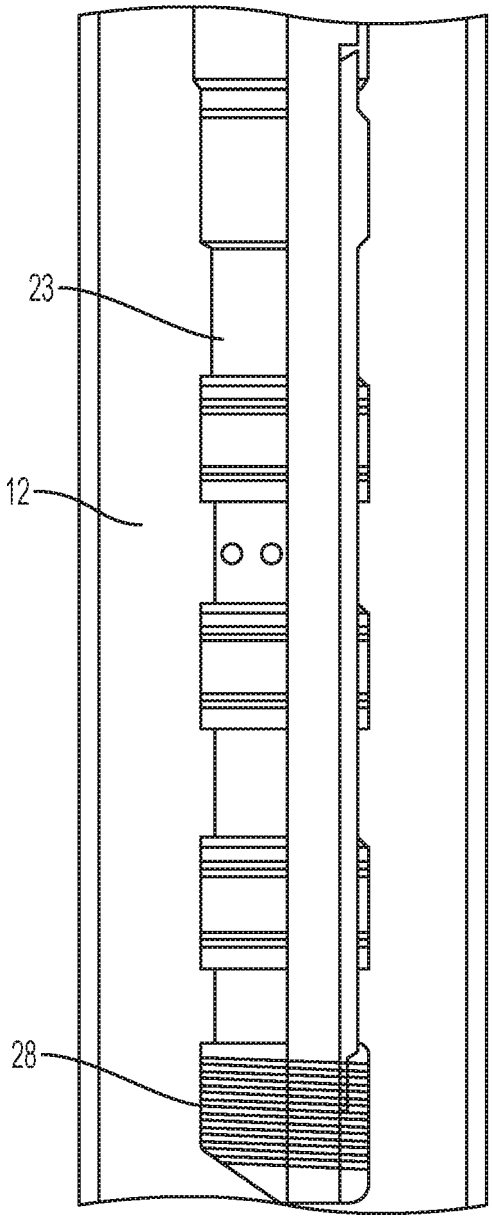
FIG. 2 is a cross-section of part of an example casing liner device for performing tie-back operations in a wellbore.
Figure 3:
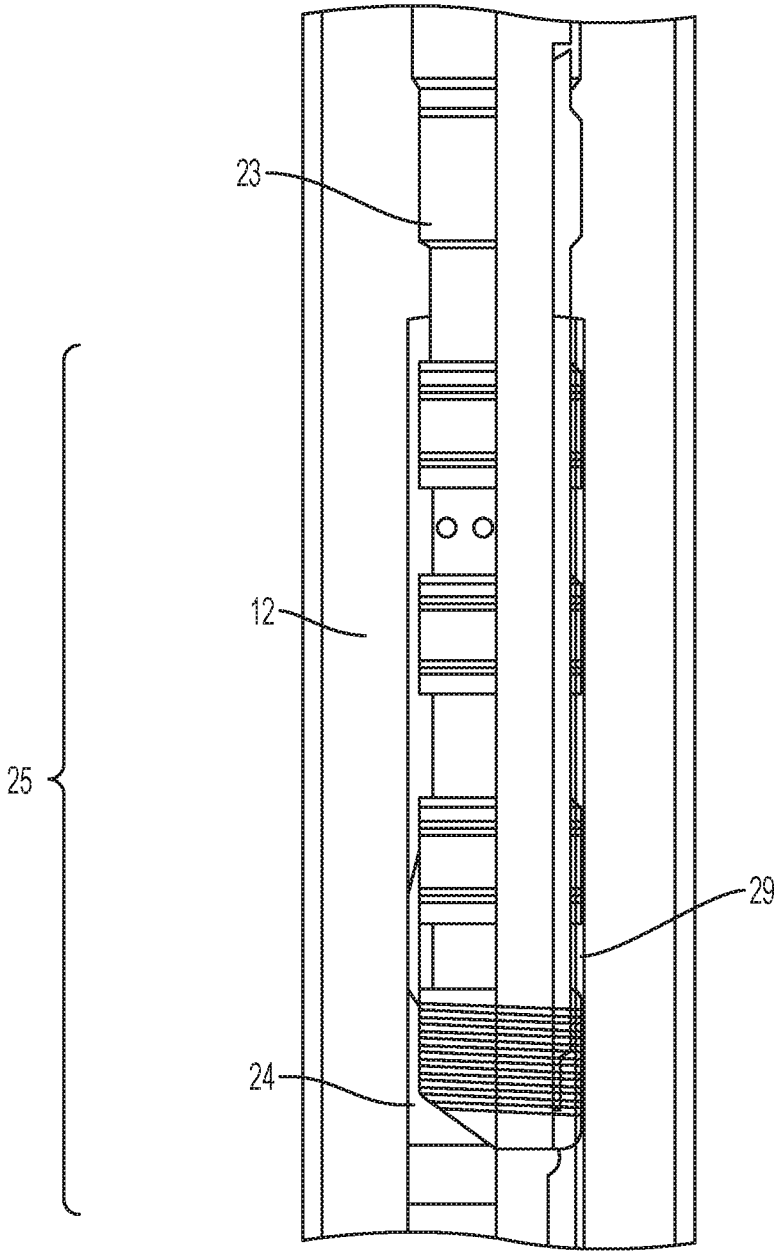
FIG. 3 is a cross-section of part of the casing liner device connected to an example polished bore receptacle (PBR) of a liner hanger.
Figure 4:
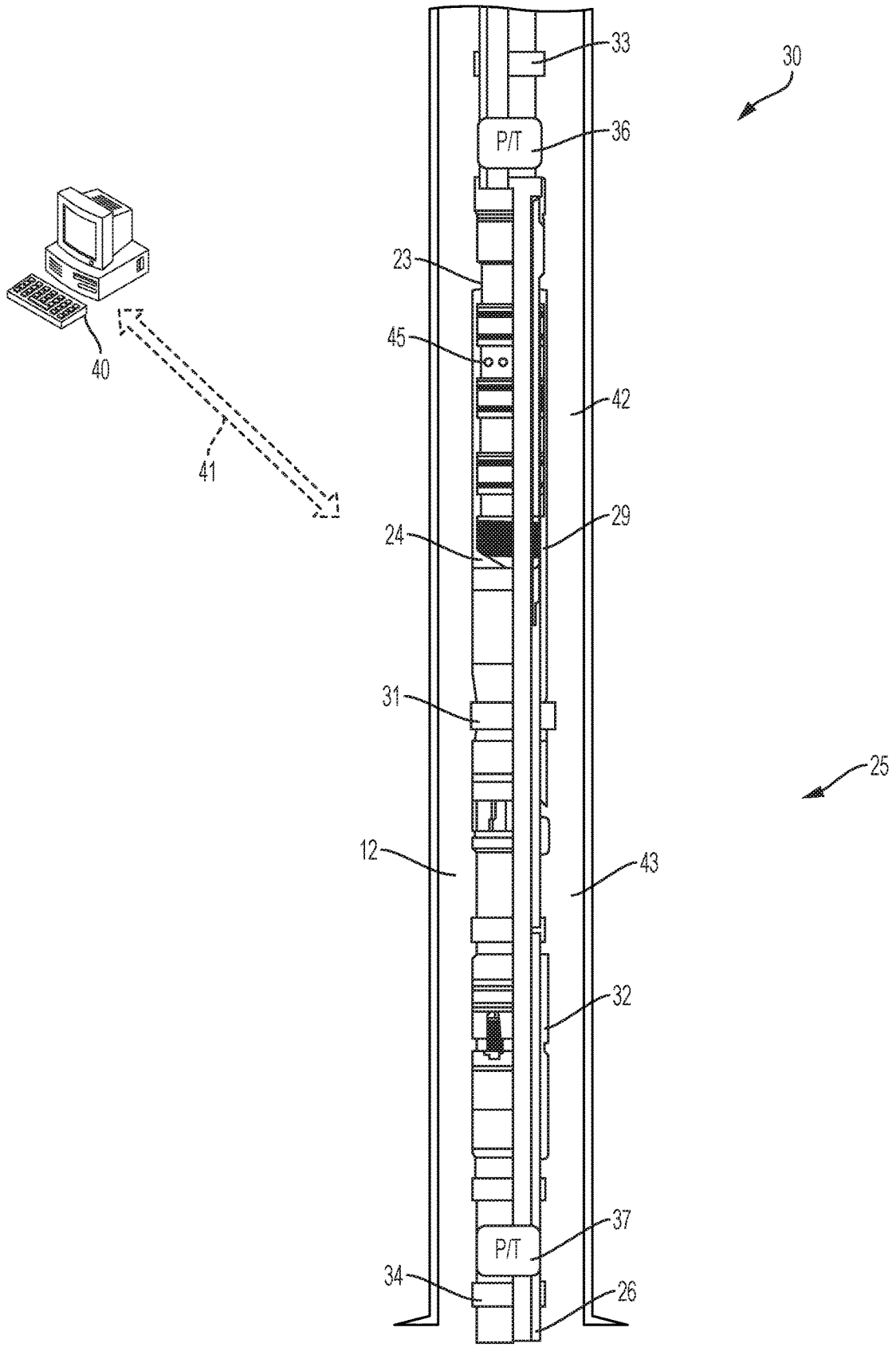
FIG. 4 is a cross-section of an example casing system that includes at least part of the casing liner device, the PBR, and other components.

Referring to the example shown in FIGS. 2 and 3, casing liner device 23 is connectable to PBR 24 to tie-back the structure to the wellhead. PBR 24 is part of a liner hanger 25 (only a portion of which is shown in FIG. 3), which supports a casing liner. By virtue of its connection to PBR 24, casing liner device 23 also becomes part of the liner hanger. In this regard, FIG. 4 shows casing liner device 23 connected to PBR 24, with the resulting structure supporting a casing liner 26, as described subsequently. In FIGS. 2 to 4, PBR 24 includes internal thread as its connection mechanism. In this example, the internal thread is a right-hand thread; however, in some implementations a different type of thread may be used. In this regard, in some implementations, a type of connection mechanism other than a thread may be used for the PBR. In this example, a casing liner device 23 includes an external thread 28 instead of a mule shoe. In this example, external thread 28 of casing liner device 23 connects to the internal thread of PBR 24, as shown in FIGS. 3 and 4 at interface 29. In some implementations, casing liner device 23 may have a connection mechanism other than an external thread that connects to a counterpart connection mechanism on the PBR. In this example, casing liner device 23 and its associated components are connected to PBR 24 and its associated devices outside of the wellbore. The resulting connected structure 30, which is shown most completely in FIG. 4 in this example, may constitute all, or part, of a liner hanger that may be used to support casing liner 26. The connected structure may support a casing, and the connected structure, along with the casing, may be run into the wellbore in a single operation or in fewer operations than with other systems.

Referring to FIG. 4, connected structure 30 also includes a packer 31 connected up-hole from a liner hanger slip 32, and casing joints 33, 34 that each may connect to a casing liner, such as casing liner 26. In some implementations, connected structure 30 also includes environmental sensors 36, 37. In some implementations, connected structure 30 need not also include environmental sensors, such as sensors 36, 37. In this example, these components, namely liner hanger slip 32, casing joints 33, 34, and environmental sensors 36, 37 are assembled with, and connected to, casing liner device 23 and PBR 24 outside of the wellbore. Accordingly, in some implementations, the entire connected structure 30 of FIG. 4 may be run into the wellbore in a single operation, including a casing liner. As describe previously, casing liner device 23 may act as a tie-back to the wellhead, enabling a tie-back operation to be implemented in a single trip into the wellbore.

In some implementations, the environmental sensors are pressure sensors, temperature sensors, or both. In some implementations, other types of sensors may be used, such as humidity sensors, gas detectors, and so forth. In implementations that include pressure and temperature (P/T) sensors, the sensors may be arranged up-hole from and down-hole from packer 31; however this is not a requirement of the example casing liner system. For example, in the implementation of FIG. 4, a pressure sensor and a temperature sensor may be up-hole of packer 31, and a pressure sensor and a temperature sensor may be down-hole of packer 31. In some implementations, the pressure and temperature sensors may be wireless sensors. In some implementations, the pressure and temperature sensors may be wired sensors. In any case, the pressure and temperature sensors may be configured to send data to and, in some cases, receive data from, a computing system 40. The data sent, received, or both, is represented conceptually by arrow 41. In some implementations, the computing system may be programmed to receive pressure data, temperature data, or both; to analyze the pressure data, temperature data, or both; and to make a determination about conditions of the well based on the analysis of the pressure data, temperature data, or both. For example, variations in pressure, temperature, or both as determined from different sensors may be indicative of a leak or other problem in the well. The computing system may alert a drilling engineer or take other appropriate action. The determinations may be made during operation of the well or during production of the well.

In an example implementation, a first pressure sensor and a first temperature sensor are positioned up-hole of packer 31, and a second pressure sensor and a second temperature sensor are positioned down-hole of packer 31. When the connected structure is inside the wellbore and packer 31 is operational, packer 31 effectively isolates a first region 42 of the wellbore containing the first pressure sensor and the first temperature sensor from a second region 43 of the wellbore containing the second pressure sensor and the second temperature sensor. First region 42 and second region 43 have expected temperatures and pressures. When one or both of the temperature and pressure in a region deviates from expectations for the region, this may indicate that there is a problem with the well, such as a leak or other problem. Changes in temperature or pressure may be indicative, for example, of leaks into fractures or problems with the drilling equipment. In an example, if the pressure up-hole from and down-hole from the packer is the same, or substantially the same, then this may be an indication that the packer is not properly isolating the two regions. In general, the environmental sensors may be used in monitoring, as appropriate, casing-to-casing annular (CCA) integrity and tubing-to-casing (TCA) annular integrity.

Although pressure and temperature sensors are used in the examples described in this specification, any appropriate environmental sensors may be used. Those sensors may, as indicated, be connected outside of the wellbore.

In some implementations, casing liner device 23 includes circulation ports 45 around all, or part, of a circumference of the casing liner device. Ports 45 enable fluid circulation and enable second stage cementing operations, as described subsequently. In this regard, in the example of FIG. 4, ports 45 are enclosed within PBR 24 when casing liner device 23 and PBR 24 are completely connected, for example, connected to form a seal. However, following running of connected structure 30 into the wellbore, casing liner device 23 may be disconnected, in whole or in part, from PBR 24. For example, casing liner device 23 may be unscrewed from PBR 24, causing casing liner device 23 to move up-hole relative to PBR 24. Movement of casing liner device 23 up-hole results in exposure of ports 45 on casing liner device 23 to the wellbore 12. During this exposure, as described subsequently, the ports may be used for fluid removal, among other things.

Figure 5:
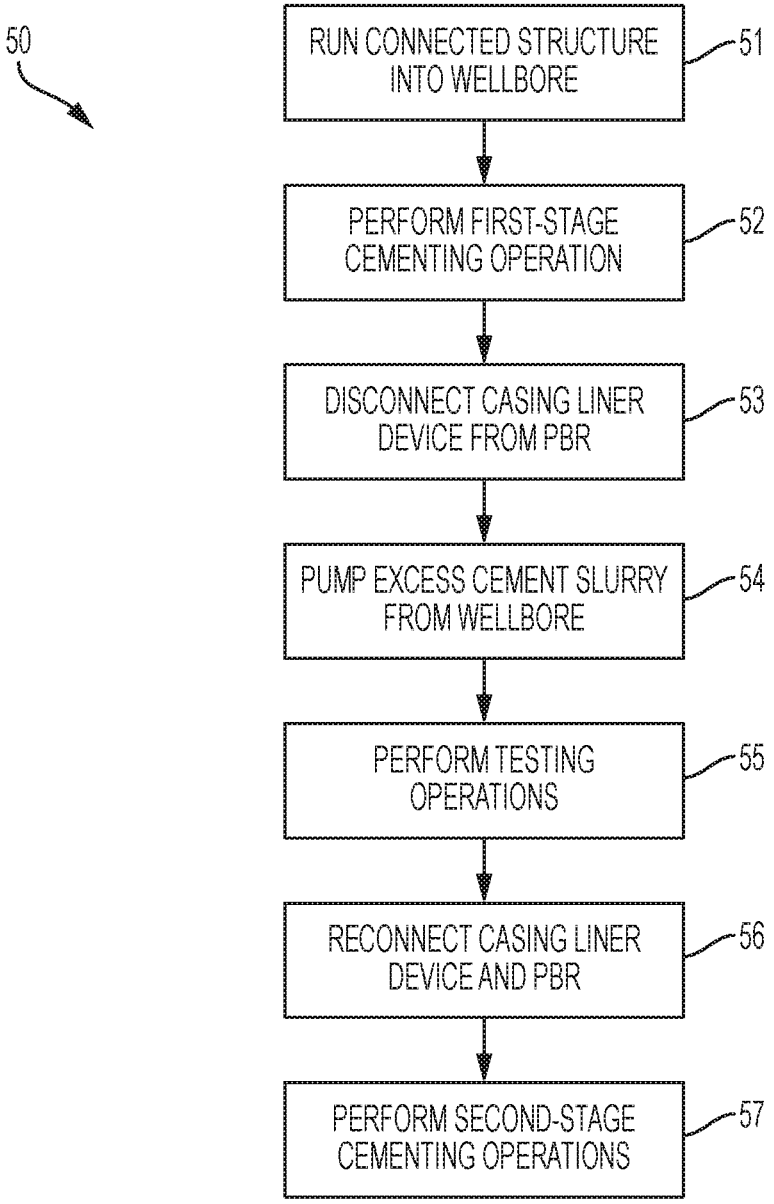
FIG. 5 is a flowchart of an example process for running a connected structure comprised of the casing liner device, the PBR, the liner hanger, and a casing liner into a wellbore, and for cementing the connected structure in the wellbore.

Referring to FIG. 5, in an example process 50, connected structure 30 including the casing liner, may be run (51) into wellbore 12 at any appropriate point in a casing liner string. In some implementations, connected structure 30, which may include the entire casing liner of the well, may be run into the wellbore using a single operation. As noted, because connected structure 30 is comprised of various connected components, a single running operation causes the casing liner device, the PBR, the casing liner, and other components to be run in tandem.

According to process 50, a first stage cementing operation is performed (51). The first stage cementing operation may be performed by introduction of cement slurry using known techniques to cement a down-hole portion of connected structure 30. In some implementations, the down-hole portion is, or includes, the portion of the wellbore that is down-hole from all or part of PBR 24. Known hydraulic liner hanger and packer (or ECP or DV) setting operations may be performed. Following these operations, first stage cementing operations are completed.

According to process 50, casing liner device 23 is disconnected (53) from PBR 24. For example, casing liner device may be unscrewed from PBR 24. This action causes casing liner device 23 to move up-hole relative to PBR 24, at least to a point where ports 45 on the casing liner device are exposed to the wellbore. For example, exposing ports 45 to the wellbore may be, or include, moving the ports so that the ports are not covered by, or enclosed in, all or part of the PBR. The ports are usable in pumping (54) excess cement slurry from the CCA/TCA structure and out of the wellbore. Pumps at the surface of the well may be employed to control pumping of the excess cement slurry. In some implementations, the pumps may be computer-controlled and may be responsive to user input or sensor readings form the wellbore. In some implementations, a computer system may also control, in whole or part, when and how the casing liner device is disconnected from the PBR.

At this stage, testing operations (55) may be performed including, but not limited to, performing positive liner packer pressure testing, and performing inflow testing by running an inner string having an inflatable packer to be set up-hole from the liner hanger and against a casing. Next, according to example process 50, casing liner device 23 may be reconnected (56), at least in part, with PBR 24 to perform second-stage cementing operations (57). For example, in some implementations, casing liner 26 may be screwed partly, but not completely, into PBR 24. In some implementations, casing liner 26 may be screwed completely into PBR 24 at this time. In this regard, if the casing liner is not completely connected to the PBR, following second-stage cementing operations (57) the casing liner is completely connected to the PBR. For example, the casing liner may be screwed completely into the PBR. In this regard, in some implementations, the PBR will have enough length to keep casing liner up-hole from the PBR's inner threaded profile, to allow sealing the casing liner and the PBR, and to allow casing hanger space-out, if needed. Following the second-stage cementing operations, the cement slurry is allowed to set and well drilling may continue.

Connected structure 30, and the techniques described previously, may be used in any appropriate wells. For example, the connected structure may be used in high-pressure, high-temperature (HPHT) wells, such as offshore oil or gas wells. Example high-temperature wells may include wells having an internal wellbore temperature in excess of 250° Fahrenheit. Example high-pressure wells may include wells having an internal wellbore pressure in excess of 7500 pounds-per-square-inch (PSI). In some examples, high-pressure wells may have an internal wellbore pressure of between 10,000 PSI and 15,000 PSI. However, connected structure 30, and the techniques described previously, are not limited to use with wells having these temperature ranges or these pressure ranges, are not limited to use with off-shore wells, and are not limited to use with oil and gas wells.

Although vertical wellbores are shown and described in the examples presented in this specification, the processes described in this specification may be implemented in wellbores that are, in whole or part, non-vertical. For example, the processes may be performed in deviated wellbores, horizontal wellbores, or partially horizontal wellbores. In some implementations, horizontal and vertical are defined relative to the Earth's surface.

All or part of the processes described in this specification and their various modifications (subsequently referred to as "the processes") may be controlled at least in part by, or employ, one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the processes can be performed by one or more programmable processors executing one or more computer programs to control all or some of the well formation operations described previously. All or part of the processes can be controlled by special purpose logic circuitry, such as, an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A method comprising:

connecting a casing liner device to a polished bore receptacle (PBR) of a liner hanger outside of a wellbore extending from a surface, the PBR comprising first threading and the casing liner device comprising second threading that is connectable to the first threading, where the PBR overlaps the casing liner device, at least partly, such that the casing liner device is disconnectable from the PBR and movable within the PBR inside the wellbore, and where the liner hanger comprises a liner hanger slip connected to the PBR;

connecting a casing liner to the liner hanger slip;

running the casing liner device connected to the PBR into the wellbore in tandem, where running the casing liner device and the PBR into the wellbore also comprises running the liner hanger slip into the wellbore along with the casing liner device and the PBR;

connecting the casing liner device to a wellhead on the surface, and following running, performing a cementing operation within the wellbore; unscrewing the casing liner device from the PBR to cause the casing liner device to move up-hole relative to the PBR and, as a result of movement up-hole, to expose circulation ports on the casing liner device to the wellbore; and pumping excess cement from the wellbore via the circulation ports.

2. The method of claim 1, further comprising:

connecting a packer to the PBR outside the wellbore;

where running the casing liner device and the PBR into the wellbore also comprises running the packer into the wellbore along with the casing liner device and the PBR.

3. The method of claim 2, where the casing liner device, the PBR, and the packer comprise a connected structure, the connected structure comprising environmental sensors for sensing one or more environmental conditions within the wellbore.

4. The method of claim 3, where the environmental sensors comprise a temperature sensor for sensing a temperature within the wellbore.

5. The method of claim 3, where the environmental sensors comprise a pressure sensor for sensing a pressure within the wellbore.

6. The method of claim 3, where the environmental sensors comprise a first sensor up-hole from the packer and a second sensor down-hole from the packer.

7. The method of claim 6, where readings from the first sensor and the second sensor are usable to detect a leak within the wellbore.

8. The method of claim 1, where the wellbore has at least one of a temperature in excess of 250° Fahrenheit or a pressure in excess of 7500 pounds-per-square inch (PSI).

9. A system comprising:

a polished bore receptacle (PBR) that is part of a liner hanger for use in a wellbore extending from a surface, the PBR comprising first threading;

a casing liner device connected to a wellhead on the surface for performing tie-back in the wellbore, the casing liner device comprising second threading that is connectable to the first threading, where the PBR overlaps the casing liner device, at least partly, such that the casing liner device is disconnectable from the PBR and movable within the PBR inside the wellbore, and comprising circulation ports that are within the PBR when the casing liner and the PBR are connected, and that are exposable to the wellbore when the casing liner device and the PBR are unscrewed and the casing liner device is moved up-hole from the PBR, thereby exposing the ports;

a liner hanger slip connected to the PBR for supporting a casing liner and environmental sensors for detecting one or more environmental conditions in the wellbore when the casing liner device and the PBR are inside the wellbore.

10. The system of claim 9, further comprising:

a packer connected up-hole from the liner hanger slip and connected to the PBR, the packer for sealing the wellbore when the casing liner device and the PBR are inside the wellbore, the environmental sensors comprising at least one sensor up-hole of the packer and at least one sensor down-hole of the packer.

11. The system of claim 9, where the environmental sensors comprise a temperature sensor for sensing a temperature within the wellbore.

12. The system of claim 9, where the environmental sensors comprise a pressure sensor for sensing a pressure within the wellbore.

13. The system of claim 9, where the environmental sensors comprise a first sensor up-hole from the packer and a second sensor down-hole from the packer.

14. The system of claim 13, further comprising:

a computing system to receive readings from the first sensor and the second sensor and to detect a leak within the wellbore based on the readings.

15. The system of claim 9, where the system is usable within the wellbore at a temperature in excess of 250° Fahrenheit, at a pressure in excess of 7500 pounds-per-square-inch (PSI), or at a temperature in excess of 250° Fahrenheit and a pressure in excess of 7500 pounds-per-square-inch (PSI).

* * * * *